US006910963B1

(12) United States Patent
Ohtsu et al.

(10) Patent No.: US 6,910,963 B1
(45) Date of Patent: Jun. 28, 2005

(54) GAME SYSTEM, GAME CONTROL METHOD, AND COMPUTER-READABLE STORAGE MEDIUM

(75) Inventors: Yuji Ohtsu, Tokyo (JP); Arata Sugiyama, Tokyo (JP)

(73) Assignee: Konami Corporation, Toyko (JP)

( * ) Notice: Subject to any disclaimer, the term of this patent is extended or adjusted under 35 U.S.C. 154(b) by 315 days.

(21) Appl. No.: 10/009,989

(22) PCT Filed: Jun. 14, 2000

(86) PCT No.: PCT/JP00/03855

§ 371 (c)(1),
(2), (4) Date: Dec. 11, 2001

(87) PCT Pub. No.: WO00/76609

PCT Pub. Date: Dec. 21, 2000

(30) Foreign Application Priority Data

Jun. 14, 1999 (JP) ..... 11/167331

(51) Int. Cl.[7] ..... A63F 9/24
(52) U.S. Cl. ..... 463/25; 463/16
(58) Field of Search ..... 463/16–21, 25; 273/138.1, 138.2, 139, 292, 143 R, 303, 202

(56) References Cited

U.S. PATENT DOCUMENTS

| | | | | | |
|---|---|---|---|---|---|
| 5,019,973 | A | | 5/1991 | Wilcox et al. | |
| 5,085,436 | A | * | 2/1992 | Bennett | 463/21 |
| 5,102,134 | A | * | 4/1992 | Smyth | 463/21 |
| 5,332,228 | A | | 7/1994 | Schultz | |
| 5,423,541 | A | * | 6/1995 | Nicastro et al. | 463/20 |
| 5,431,408 | A | * | 7/1995 | Adams | 273/306 |
| 5,569,084 | A | * | 10/1996 | Nicastro et al. | 463/20 |
| 5,833,537 | A | * | 11/1998 | Barrie | 463/21 |
| 5,853,325 | A | | 12/1998 | Kadlic | |
| 5,984,781 | A | * | 11/1999 | Sunaga | 463/20 |
| 6,089,977 | A | * | 7/2000 | Bennett | 463/20 |
| 6,159,096 | A | * | 12/2000 | Yoseloff | 463/20 |
| 6,168,520 | B1 | * | 1/2001 | Baerlocher et al. | 463/16 |
| 2003/0027628 | A1 | * | 2/2003 | Luciano | 463/20 |

FOREIGN PATENT DOCUMENTS

| | | | | |
|---|---|---|---|---|
| JP | 07-289687 | | 11/1995 | |
| JP | 07-313661 | | 12/1995 | |
| JP | 07-313728 | | 12/1995 | |
| JP | 09220369 | | 8/1997 | |
| JP | 10165593 | | 6/1998 | |
| WO | WO-97/31344 | * | 8/1997 | G07F/17/34 |
| WO | WO 97/32285 | | 9/1997 | |

* cited by examiner

*Primary Examiner*—Mark Sager
*Assistant Examiner*—Steven Ashburn
(74) *Attorney, Agent, or Firm*—Jordan and Hamburg LLP

(57) ABSTRACT

In a game system having a display unit capable of displaying a game screen (100), an input unit for supplying a signal corresponding to a player's operation, and a game controller for executing a predetermined game on the screen of the display unit with reference to an output signal from the input unit, in which the game controller selects a predetermined number of trump cards (110 . . . 110) as the symbol to be displayed on the game screen from a predetermined selection candidate group, controls a dividend for a player based on a combination of the selected cards (110), and controls a probability of a dividend by adding or removing at least the joker (110*a*) as one common symbol which can be used as a plurality of cards (110) to or from the selection candidate group, according to the outcome of the game.

12 Claims, 12 Drawing Sheets

| | 7BET | 8BET | 9BET | MAXBET |
|---|---|---|---|---|
| Five Joker | 7000 | 8000 | 9000 | 20000 |
| Royal Staright Flush | 2100 | 2400 | 2700 | 3000 |
| Five of a Kind | 700 | 800 | 900 | 1000 |
| Staright Flush | 140 | 160 | 180 | 200 |
| Four of a Kind | 70 | 80 | 90 | 100 |
| Full House | 28 | 32 | 36 | 40 |
| Flush | 21 | 24 | 27 | 30 |
| Staright | 21 | 24 | 27 | 30 |
| Three of a Kind | 14 | 16 | 14 | 20 |
| Two Pair | 7 | 8 | 9 | 10 |

MAX BET
9 BET
8 BET
7 BET
6 BET
5 BET
4 BET
3 BET
2 BET
1 BET

GAME SYSTEM, GAME CONTROL METHOD, AND COMPUTER-READABLE STORAGE MEDIUM

TECHNICAL FIELD

The present invention relates to a game system for performing a game, such as poker, of forming a predetermined hand in combination of number, suit, and mark on a video screen.

BACKGROUND ART

As a kind of an arcade game machine, there is known that one for performing a poker game on a video screen. In this kind of the game machine, a predetermined number of cards are distributed to a player as a hand (typically, five cards) on a screen, and if a combination set as a lucky hand is included in the above hand, a player wins and a predetermined dividend is given to the player. A total of 53 cards is used in the game similarly to in the actual trump game, including one joker and four suits; hearts, diamonds, clubs, and spades respectively consisting of 13 cards. A probability of selecting each card is evenly set in the four suits. Accordingly, a probability of completing a lucky hand of the poker is the same as that in the general game.

In the above-mentioned game system, there are some systems of producing a probability fluctuation mode in which a probability of completing a lucky hand is increased if a predetermined condition is satisfied. When it enters into the probability fluctuation mode, a player can get a large amount of dividend. Therefore, a game system with the probability fluctuation mode can enhance the player's expectation for a greatest hit as well as attract the player's fun extremely.

In the conventional game system, however, the number of the cards used in a game remains as it is and a probability of producing a lucky hand is increased by varying the calculation in deciding the cards that a computer distributes to a player. In this case, there may occur a change such as continuous occurrence of a lucky hand or easy occurrence of a lucky hand which would be ordinarily hard to complete. This may cause a player to feel unnatural in the outcome of a game and spoil the player's interest in the game.

DISCLOSURE OF THE INVENTION

An object of the present invention is to provide a game system, a game control method, and a storing medium suitable for these, capable of changing a probability without causing a player to feel unnatural in the game.

In order to achieve the above object, the game system according to the first embodiment of the present invention has a display unit capable of displaying a game screen, an input unit for supplying a signal corresponding to a player's operation, and a game controller for executing a predetermined game on the screen of the display unit with reference to an output signal from the input unit, wherein the game controller comprises: a selecting device which selects a predetermined number of symbols to be displayed on the game screen from a predetermined selection candidate group; a dividend controlling device which controls a dividend for a player based on a combination of the selected symbols; and a probability controlling device which controls a probability of the dividend by adding or removing at least one common symbol which can be used as a plurality of symbols to or from the selection candidate group, according to the outcome of the game.

Thus, even if an operation of intentionally increasing and decreasing the probability of selecting each symbol from the selection candidate group is not performed, the probability of completing a specified combination as a lucky hand where a player can obtain a dividend becomes higher according as the number of the common symbols included in the selection candidate group is increased. On the contrary, according as the number of the common symbols is decreased, the probability of completing a specified combination becomes lower. The common symbol is included in the symbols distributed to a player, resulting in making it easier to complete a lucky hand. Therefore, a player hardly feels unnatural in the game content, compared with the case of intentionally increasing a possibility of generating a specified symbol for forming a lucky hand without using such a common symbol. Further the present invention can set the probability fluctuation mode without intentionally tampering the probability of selecting a specified symbol. The symbol includes various identification marks of character, figure, code, pattern, sign, and the like, and any symbol will do as far as its identification mark can be distinguished from the other. As the display form of a symbol, each symbol may be displayed only in a single pattern, or it may be displayed by using the form of the trump cards.

In the game system of the present invention, the probability controlling device may add the common symbol to the selection candidate group when the outcome of the game satisfies a predetermined start condition.

In this way, when the predetermined start condition is satisfied in a game executed by the game controller, a probability of completing a predetermined combination is increased. This gives a player a strong impression on the greatest hit, thereby enhancing the player's fun.

In the game system of the present invention, the probability controlling device may judge that the start condition is satisfied when the combination of the selected symbols forms a predetermined probability fluctuating hand and may add the common symbol.

In this way, when the probability fluctuating hand is completed by the selected symbol, a probability of completing a predetermined lucky hand and gaining a dividend is thereafter increased.

The game system of the present invention further comprises a condition controlling device for increasing the number of the probability fluctuating hands according as the value of a play that a player sets is greater.

In this way, the probability of gaining a dividend is increased according as the value of a play set greater, and on the contrary, there may occur a situation of losing the great value of a play at once. Although there is not such a risk if the play value is small, a possibility of completing the probability fluctuating hand and getting a favorable situation is decreased. Thus, since the character of a game varies according to the play value, a player can select the way of playing a game according to his or her taste. The value of a play can be represented by, for example, the number of the medals.

In the game system of the present invention, the probability controlling device may remove at least one common symbol from the selection candidate group when the outcome of the game satisfies a predetermined finish condition after the common symbol is added to the selection candidate group.

In this way, when the probability of gaining a dividend is increased because of an increase in the number of the common symbols, if the outcome of a game thereafter satisfies a predetermined finish condition, the probability of a player's gaining a dividend is decreased. This gives a player such an impression that the state of the high probability is limited to a certain period as a special mode, thereby enhancing the attraction of a game.

In the game system of the present invention, the probability controlling device may judge that the finish condition is satisfied when the dividend controlling device produces a predetermined dividend and remove the common symbol.

According to this, when a predetermined dividend is produced after the probability of gaining a dividend is increased, the probability is then decreased. This can prevent from unlimited payment of a dividend in the state of the high probability. Further, it can properly keep the balance between a dividend and an income in the game system. A given dividend may be judged to have been produced when the value of a dividend reaches a predetermined value, or a given dividend may be judged to have been produced when the times of a dividend reaches a predetermined number.

In the game system of the present invention, the selecting device can change at least one part of the already selected symbols to another symbol selected from the selection candidate group, according to an instruction given from a player through the input unit, and the probability controlling device may judge that the finish condition has been satisfied when the accumulated times the selected symbol forms a predetermined combination reaches a predetermined constant and may remove the common symbol.

In this way, when the number of the times a player gains a dividend by a combination of the selected symbols reaches a predetermined number, the probability of gaining a dividend is decreased because of the removal of the common symbol. On the other hand, since at least one part of the symbols can be changed, when a combination of a low ranking hand is formed, a player can change the symbols so as to disturb the combination. Therefore, a player can devise a way of advancing a game so as to form a combination of a high ranking hand under the condition of the higher probability.

In the game system of the present invention, a probability of the selecting device selecting the respective symbols from the selection candidate group may be evenly set in the respective symbols.

According to this, a player doesn't feel unnatural as for the probability of selecting the respective symbols.

In the game system of the present invention, the trump cards may be used as the symbol, and the dividend controlling device may produce a dividend when a predetermined lucky hand is formed by a combination of the selected symbols in a card game using the trump cards.

According to this, since the trump cards are used as the symbols, a player feels familiar to a game. When the probability controlling device adds the joker as the common symbol to the selection candidate or removes the joker from the selection candidate, a player can understand easily that the number of the jokers depends on the possibility of completing a lucky hand.

A game system according to the second embodiment of the present invention has a display unit capable of displaying a game screen, an input unit for supplying a signal corresponding to a player's operation, and a game controller for executing a predetermined game on the screen of the display unit with reference to an output signal from the input unit, wherein the game controller comprises: a selecting device which selects a predetermined number of symbols to be displayed on the game screen from a predetermined selection candidate group; a dividend controlling device which controls a dividend for a player based on a combination of the selected symbols; and a probability controlling device which controls a probability of the dividend by changing content of the selection candidate group according to the outcome of the game.

In this way, the probability of completing a specified combination can be varied only by changing the content of the selection candidate group (the number and the kind), without intentionally tampering the probability of selecting the respective symbols from the selection candidate group. Accordingly, a player hardly feels unnatural in the game content, compared with the case of intentionally increasing a possibility of generating a specified symbol for forming a lucky hand, with the selection candidate group remaining as it is. Further the present invention can set the probability fluctuation mode without intentionally tampering the probability of selecting a specified symbol. Similarly to the game system of the first embodiment, the symbol includes various identification marks of character, figure, code, pattern, sign, and the like, and any symbol will do as far as its identification mark can be distinguished from the other. As the display form of a symbol, each symbol may be displayed only in a single pattern, or it may be displayed by using the form of the trump cards.

A game controlling method of the present invention is to execute a predetermined game on a screen of a predetermined display unit by using a computer installed in a game system, in which the computer executes the following processes of: selecting a predetermined number of symbols to be displayed on the game screen from a predetermined selection candidate group; controlling a dividend for a player based on a combination of the selected symbols; and controlling a probability of the dividend by adding or removing at least one common symbol which can be used as a plurality of symbols to or from the selection candidate group, according to the outcome of the game.

A computer readable storing medium of the present invention is to store a program for executing a predetermined game on a screen of a predetermined display unit by using a computer installed in a game system, in which the program works the computer as a selecting device for selecting a predetermined number of symbols to be displayed on the game screen from a predetermined selection candidate group; a dividend controlling device which controls a dividend for a player based on a combination of the selected symbols; and a probability controlling device which controls a probability of the dividend by adding or removing at least one common symbol which can be used as a plurality of symbols to or from the selection candidate group, according to the outcome of the game.

According to this method or this storing medium, the game system can be formed easily.

A game controlling method according to the other embodiment of the present invention is to execute a predetermined game on a screen of a predetermined display by using a computer installed in a game system, in which the computer executes the following processes of: selecting a predetermined number of symbols to be displayed on the game screen from a predetermined selection candidate group; controlling a dividend for a player based on a combination of the selected symbols; and controlling a probability of the dividend by changing content of the selection candidate group according to the outcome of the game.

A computer readable storing medium according to the other embodiment of the present invention is to store a program for executing a predetermined game on a screen of a predetermined display unit by using a computer installed in a game system, in which the program works the computer as: a selecting device which selects a predetermined number of symbols to be displayed on the game screen from a predetermined selection candidate group; a dividend controlling device which controls a dividend for a player based on a combination of the selected symbols; and a probability controlling device which controls a probability of the dividend by changing content of the selection candidate group according to the outcome of the game.

According to this method or this storing medium, the above-mentioned game system of the second embodiment can be formed easily.

BEST MODE FOR CARRYING OUT THE INVENTION

Figure 1:
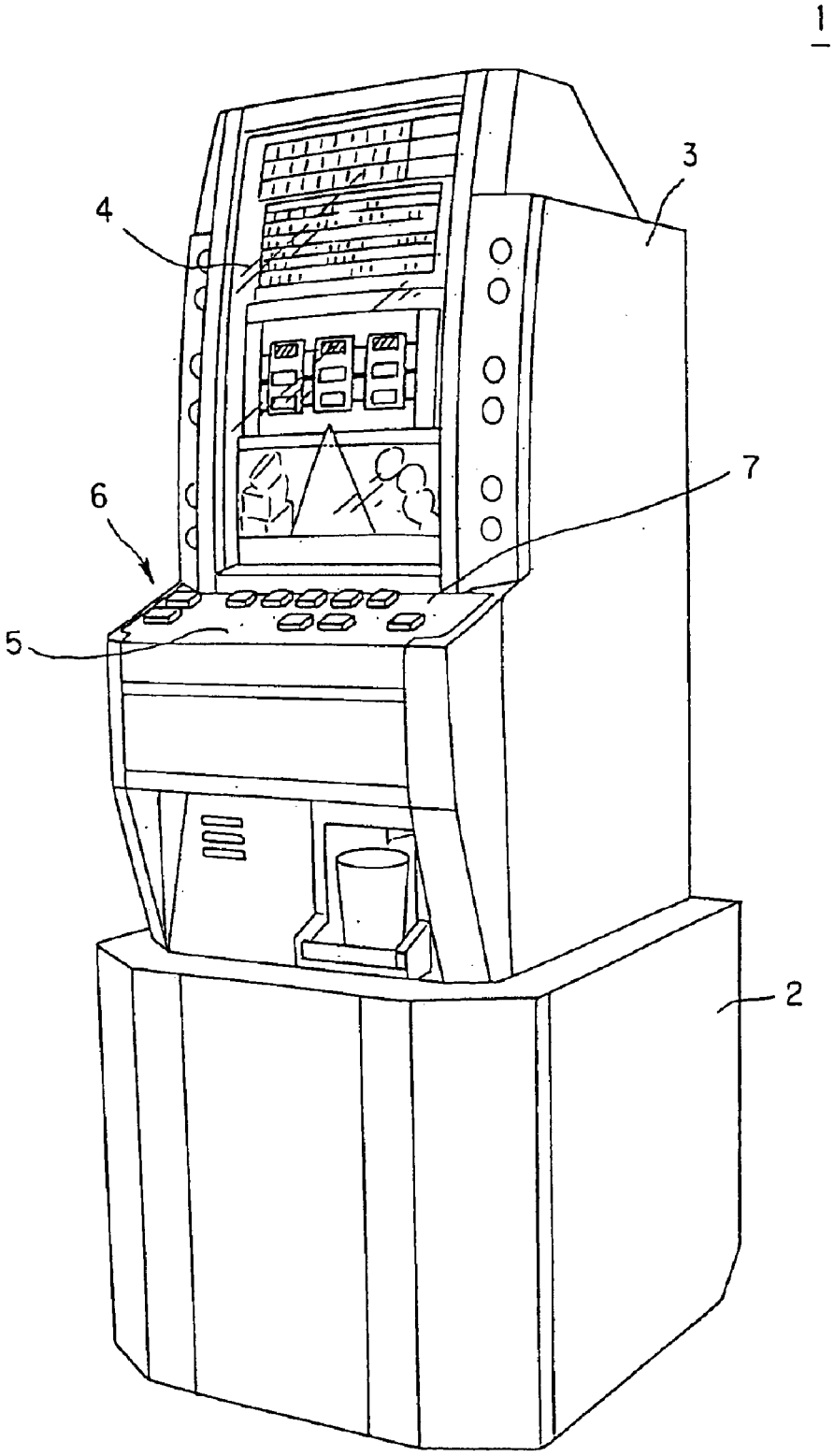
FIG. 1 is a perspective view showing the appearance of an arcade game machine according to an embodiment of the present invention.
Figure 2:
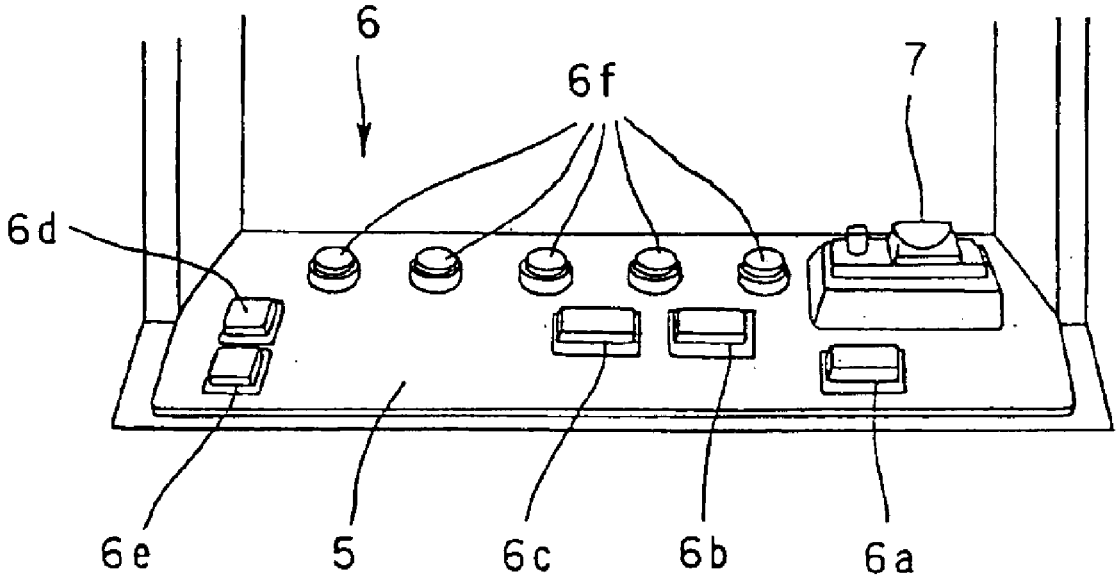
FIG. 2 is a view showing the detail of a control panel provided in the arcade game machine of FIG. 1.

FIG. 1 shows an appearance of a game system to which the present invention is adopted. The game system is formed as an arcade game machine 1 installed in a game center and the like. The game system comprises a base 2, a casing 3 placed on the base 2, and a monitor 4 as a display unit installed in the upper portion of the casing 3. The monitor 4 is composed by a CRT and installed in the casing 3 with its longitudinal direction fixed in the vertical direction. A control panel 5 is provided in the lower front portion of the casing 3. The control panel 5 has an input unit 6 and a medal slot 7. As illustrated in FIG. 2, the input unit 6 is provided with a plurality of operation buttons 6*a* to 6*f* which function as push button switches. The number of the buttons and their positions can be decided freely. In the example shown in FIG. 2, a deal/draw/double button. 6*a*, a max bet button 6*b*, a one-bed button 6*c*, a half double button 6*d*, a collect/payout button 6*e*, and hold buttons 6*f* . . . 6*f* are prepared.

Figure 3:
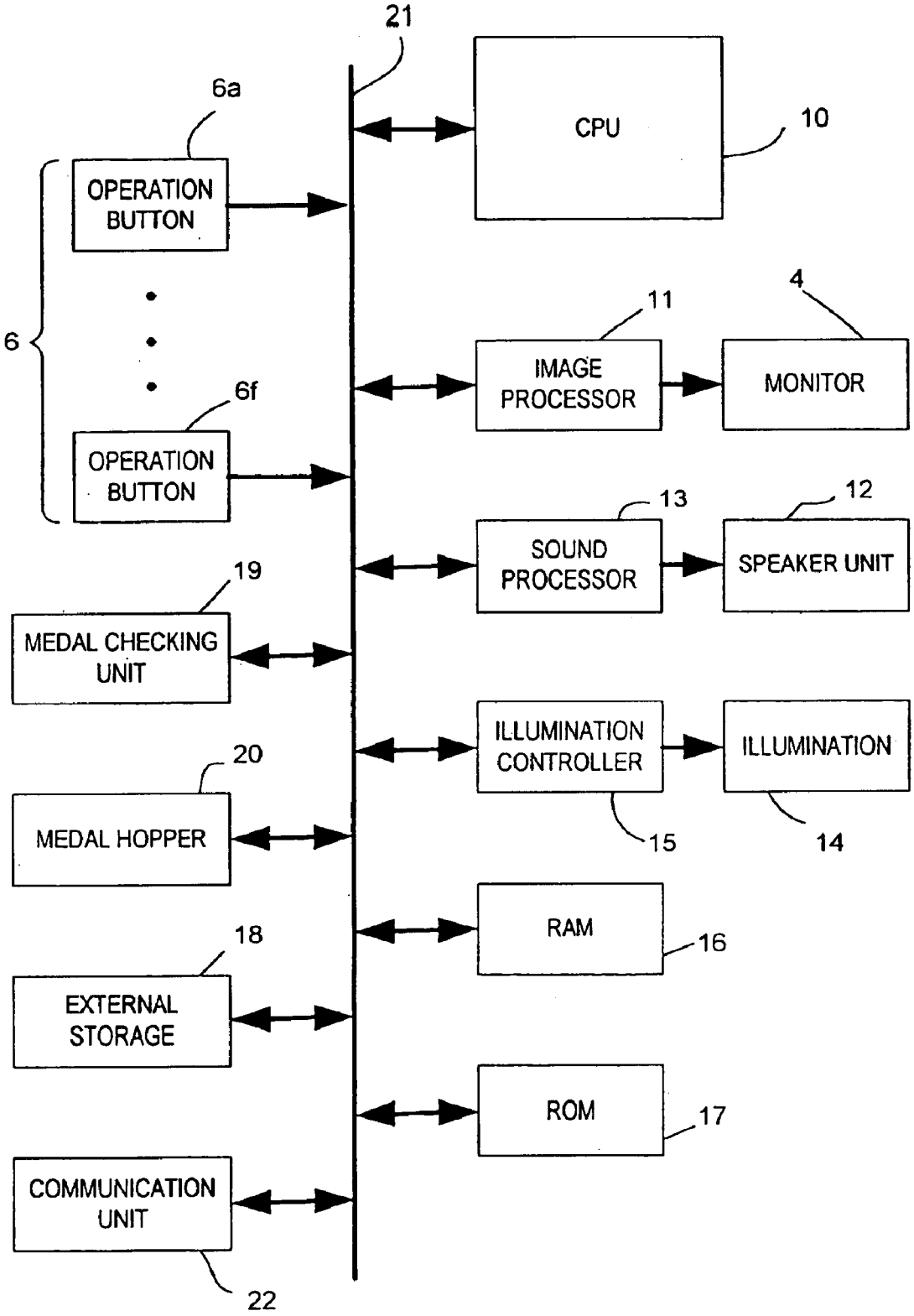
FIG. 3 is a block diagram showing a structure of a control system provided in the arcade game machine of FIG. 1.

FIG. 3 shows a structure of a control system installed in the game machine 1. The game machine 1 has a CPU 10 for performing various calculations and operation controls necessary for advancing a game. The CPU 10 is electrically connected through a bus 21 with an image processor 11 for drawing a desired image on the monitor 4 according to the instruction of the CPU 10, a sound processor 13 for supplying a desired sound through a speaker unit 12 according to the instruction of the CPU 10, an illumination controller 15 for controlling the flash of illuminations 14 of the game machine 1 according to the instruction of the CPU 10, a RAM 16, a ROM 17, and an external storage 18 as storing device, a medal confirming unit 19 for discriminating the validity of medals which are put in from the medal slot 7 of the casing 3 (refer to FIG. 1), and a medal hopper 20 for storing the valid medals and paying out the number of coins according to the instruction of the CPU 10. A program and data necessary to control the basic operation at the activation of the game machine 1 are written in the ROM 17. The external storage 18 has a magnetic, an optical or a photo-electro-magnetic storing medium. A program and data necessary to execute a predetermined card game on the screen of the monitor 4 are stored in the storage medium. Alternatively, the external storage 18 may be omitted, and a game program and data may be recorded in the ROM 17.

The CPU 10 is also connected with the above-mentioned respective operation buttons 6*a* to 6*f* of the input unit 6 through the bus 21. The CPU 10 is further connected with a communication unit 22 through the bus 21. Input/output interfaces are installed in the connected portion of the bus 21 and the above-mentioned respective units, depending on necessity. They are not illustrated here.

The communication unit 22 is installed between the game machine 1 and a progressive unit, not illustrated, in order to exchange information therebetween to control payout and storage of a progressive bonus. Namely, a plurality of game machines including the game machine 1 are connected with the progressive unit. The respective game machines inform the progressive unit of the number of the bet medals. The progressive unit stores a certain ratio on the number of the informed medals as a progressive bonus and informs the respective game machines of the number of the stored medals. When the terms of payment for the progressive bonus are satisfied in some game machine, the progressive unit gives an instruction to pay out the progressive bonus to the game machine. The game machine which receives the instruction pays out the number of the medals permitted as the progressive bonus.

Figure 4:
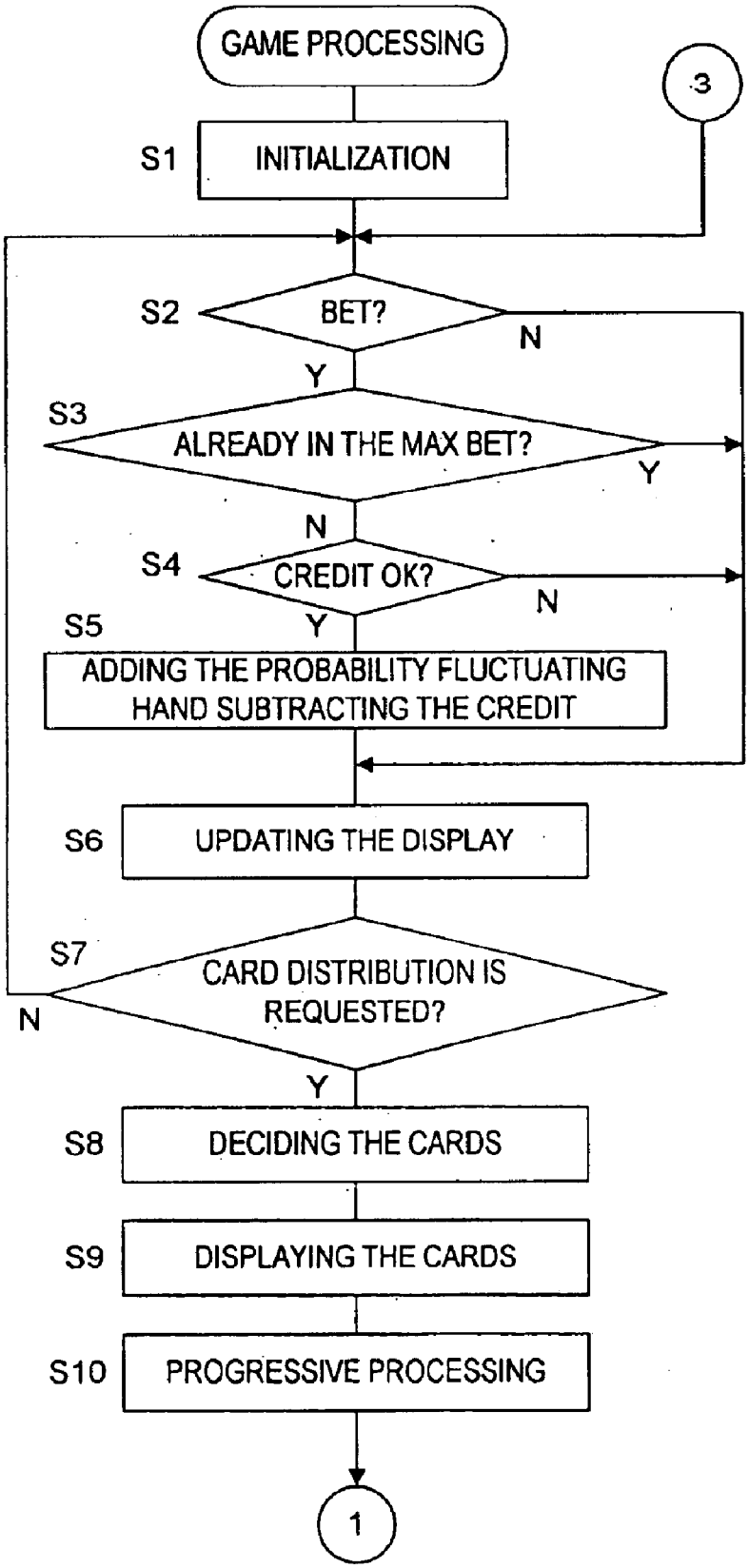
FIG. 4 is a flow chart showing the procedure of the game processing executed by a CPU of FIG. 3.
Figure 5:
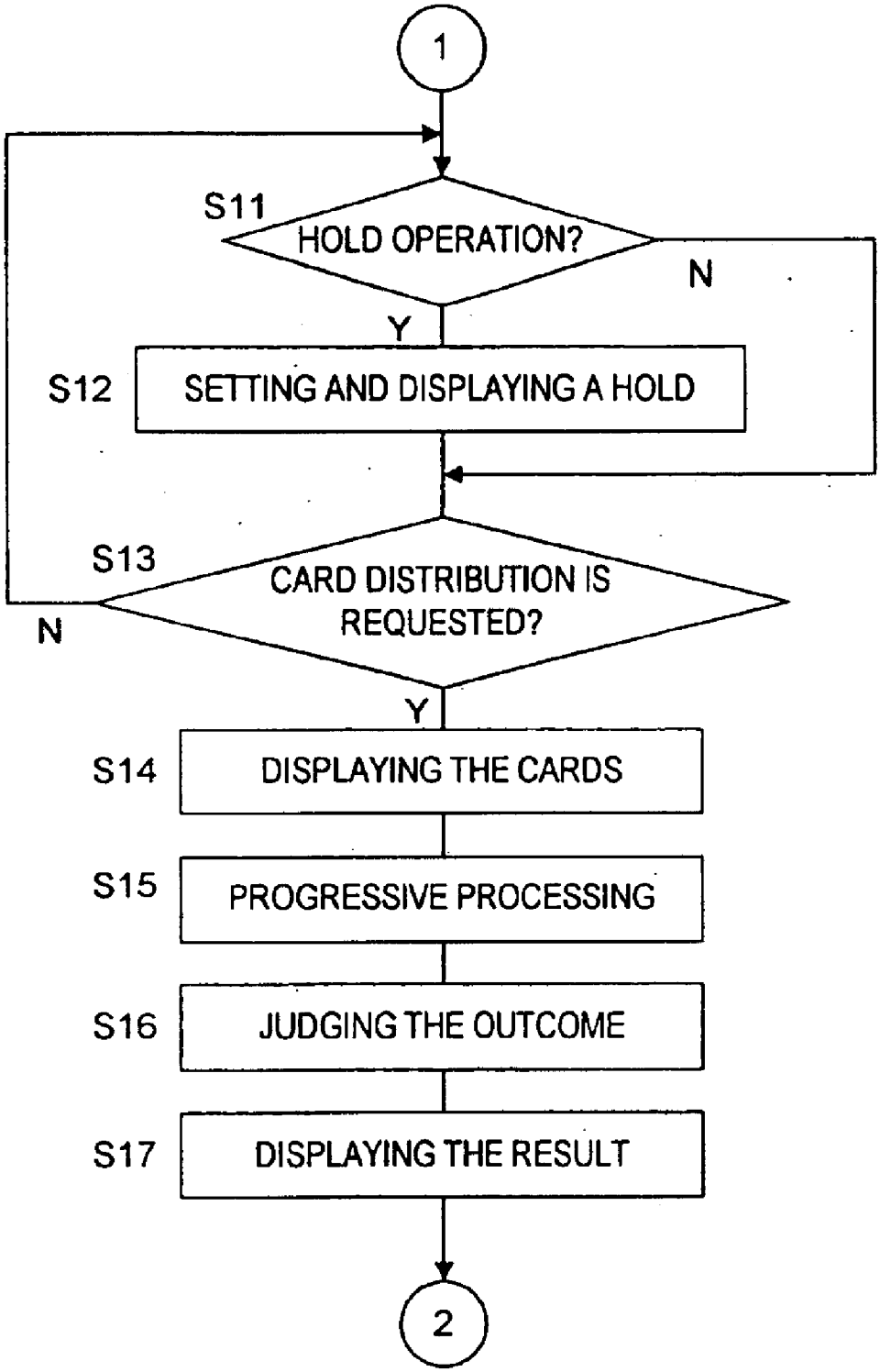
FIG. 5 is a flow chart following FIG. 4.
Figure 6:
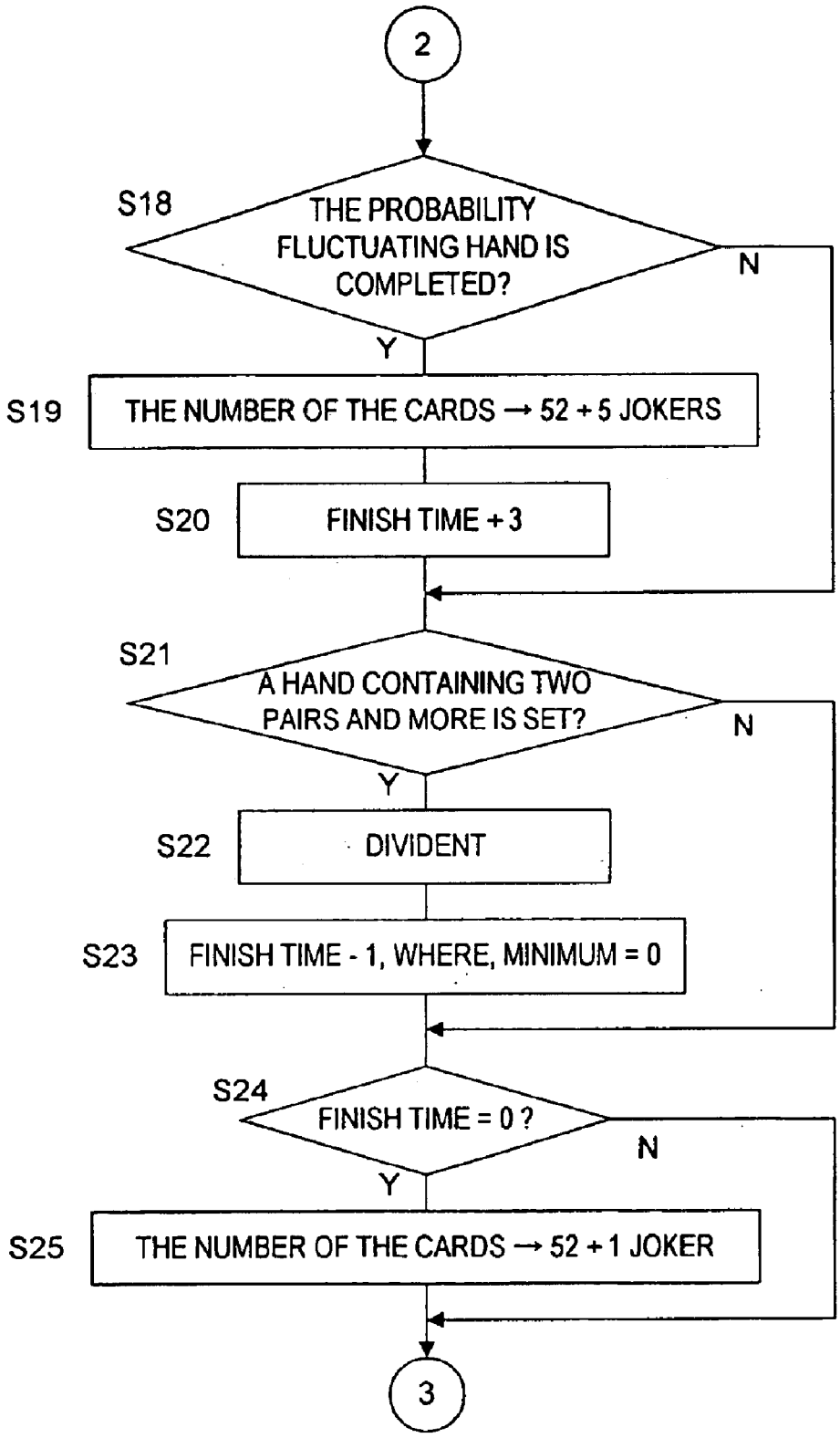
FIG. 6 is a flow chart following FIG. 5.

The CPU 10 of the game machine 1 can optionally execute several kinds of card games according to a game program stored in the external storage 18 (or the ROM 17). FIGS. 4 to 6 are flow charts respectively showing the procedure of the CPU 10 when one of the card games is selected. FIGS. 7 to 12 respectively show a screen example displayed on the monitor 4 in the card game. The card game executed here corresponds to the poker of the tramp. The basic procedure is as follows.

Figure 7:
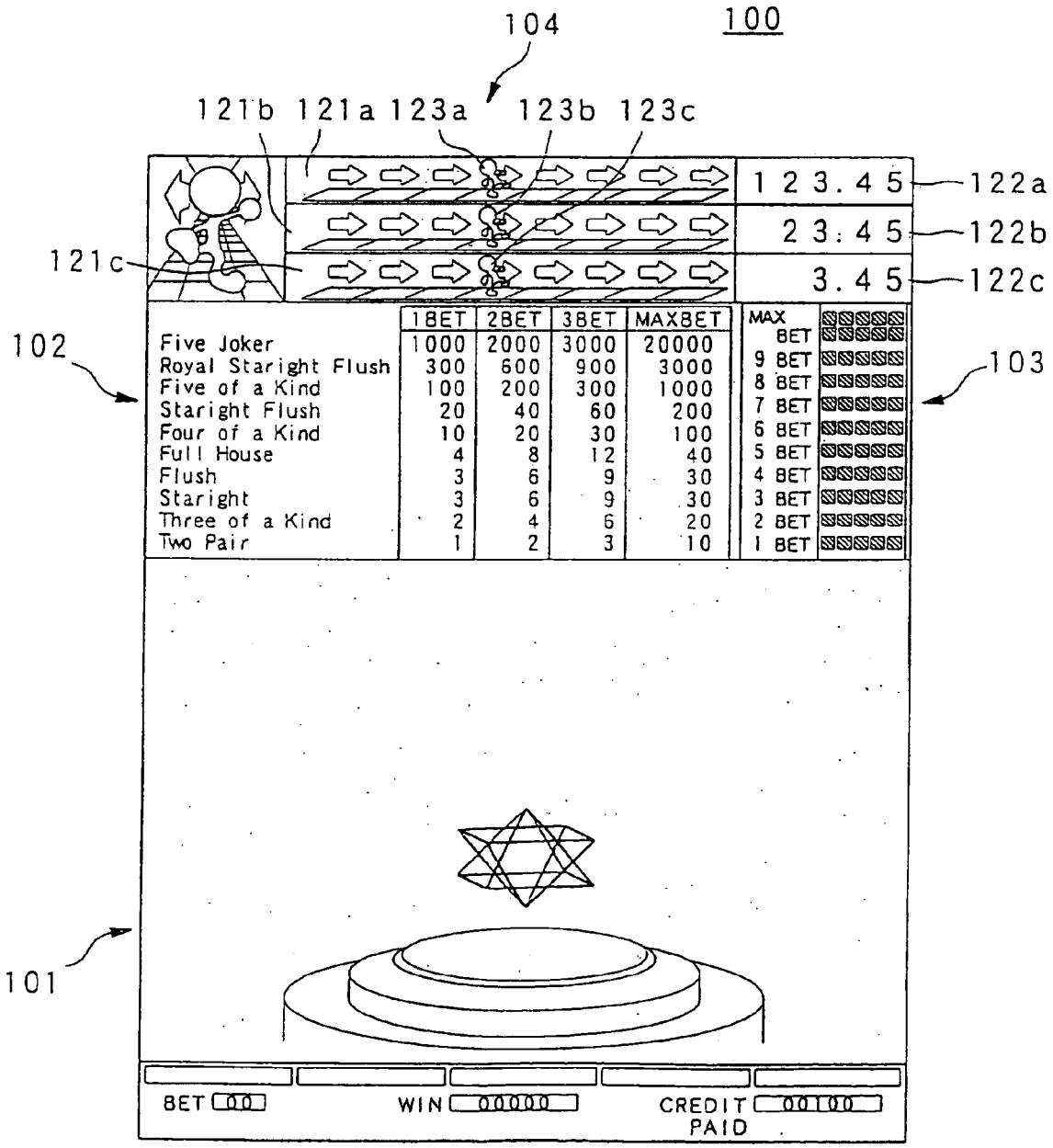
FIG. 7 is a view showing a front surface before a bet of a poker game performed by the game machine of FIG. 1.

First, when the game starts, a game initial screen 100 as shown in FIG. 7 appears on the monitor 4. On the game screen 100, a card display area 101, an odds display area 102, a probability fluctuating hand displaying area 103, and a bonus information display area 104 are provided. Only a background image is displayed in the card display area 101 until a bet is completed. When the bet is completed and a game starts, five trump cards 110 . . . 110 are displayed (refer to FIG. 9). The odds (the ratio of a dividend) for every lucky hand of the poker is displayed on the odds display area 102. In this example, a lucky hand includes two pairs and more; in two pairs, the odds is set as the first time, and in the royal straight flush, the odds is set as 300 times. The greatest hand of the highest dividend includes five jokers, and the odds is set as 1000 times (where, at the max bet, it is set as 2000 times). In the ordinal poker, only one joker is used and there is no possibility of getting five jokers. In this embodiment, however, if a predetermined condition is satisfied, the probability fluctuation mode starts and the number of the jokers is changed to five, thereby producing the possibility of getting five jokers. Then, the odds is set as for five jokers.

Figure 8:
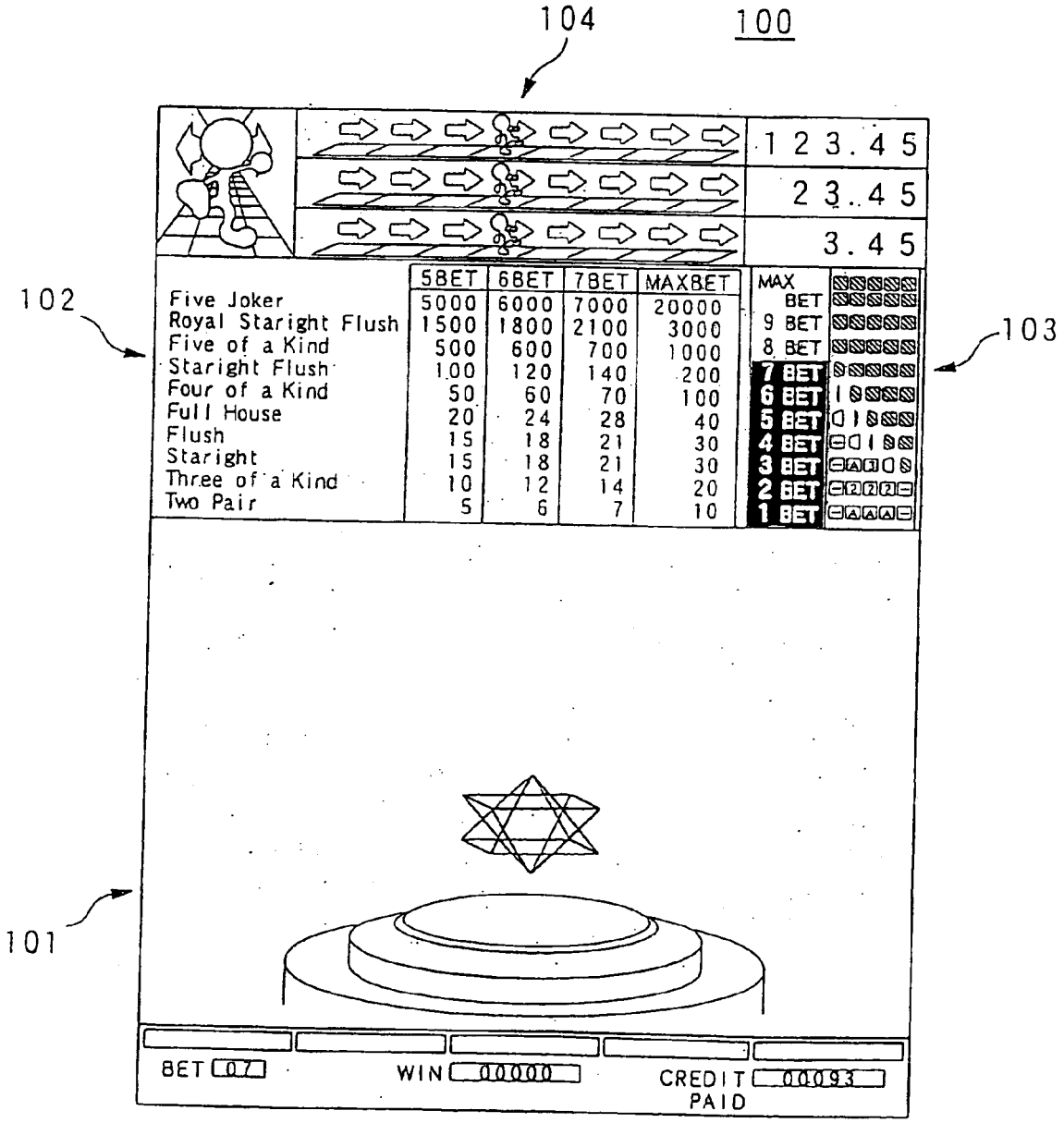
FIG. 8 is a view showing a screen during a bet of a poker game performed by the game machine of FIG. 1.
Figure 9:
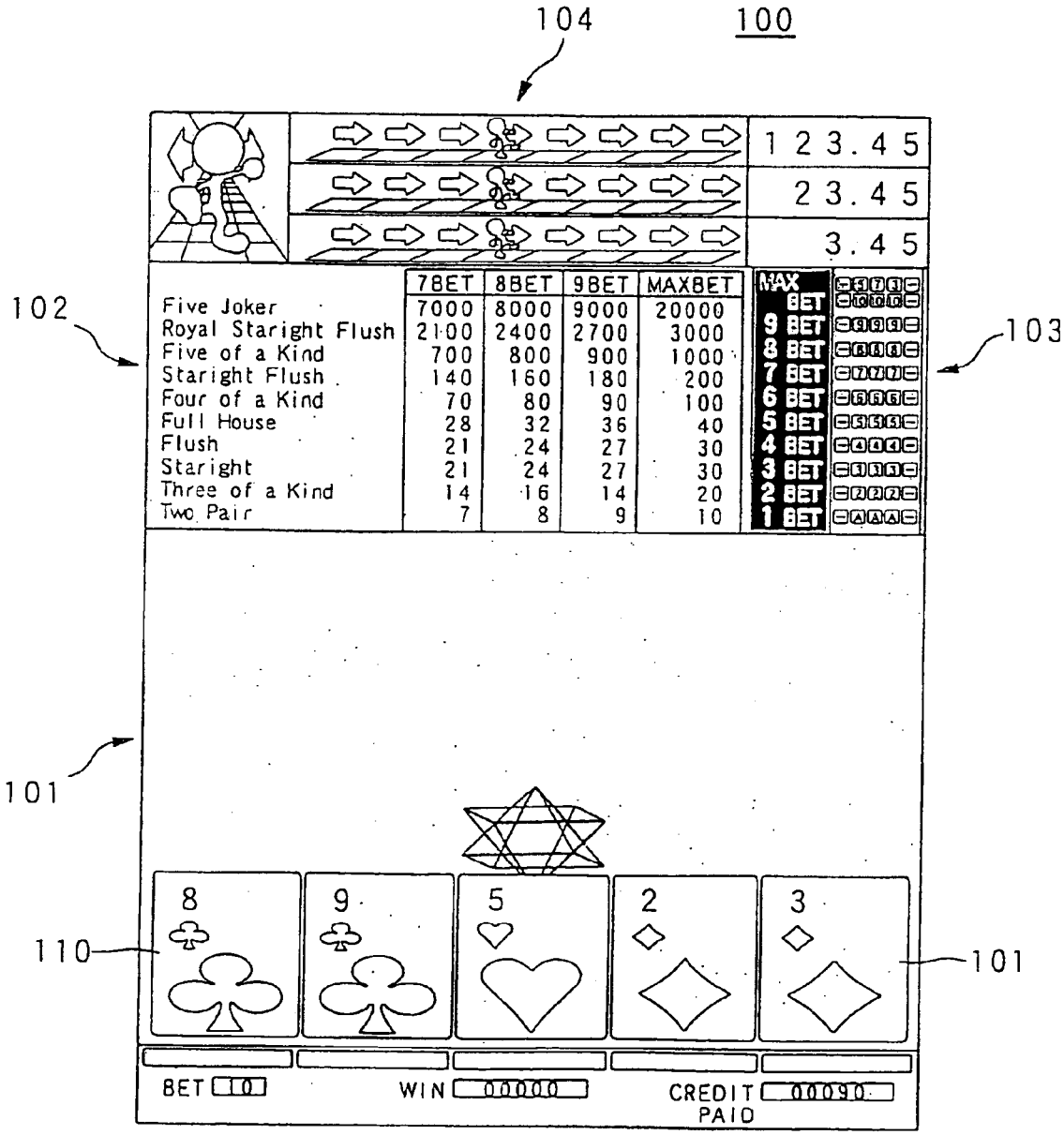
FIG. 9 is a view showing a screen after delivering cards in a poker game performed by the game machine of FIG. 1.

A hand for starting the probability fluctuation mode is respectively displayed in the probability fluctuating hand displaying area 103, correspondingly to the number of bet from one to the max bet (ten). Before the start of a bet, the probability fluctuating hands are faced down (FIG. 7). When a bet is performed, the probability fluctuating hand corresponding to the number of the bet at that point is displayed. For example, FIG. 8 shows the state of opening the probability fluctuating hands from 1 bet to 7 bet as seven medals are betted. FIG. 9 shows the probability fluctuating hand displaying area 103 at the max bet. For example, the probability fluctuating hand "-AAA-" corresponding to 1 bet means that, of the five cards, three cards in the middle portion are A (ace) and that any card will do in the both end portions. It is the same as for each probability fluctuating hand corresponding to 2 bet and more. When the number of the bet is two and more, not only the probability fluctuating hand assigned to the same number of the bet but also all the probability fluctuating hands assigned to the respective numbers of the bet less than the same number become effective.

When a player finishes the betting operation, five cards 110 are distributed (FIG. 9). Each distributed card can be exchanged only once. The five cards 110 correspond to the hold buttons 6*f* in a one-to-one relationship. When a player pushes the hold button 6*f* on the card 110 that the player doesn't want to exchange, the character "HOLD" appears on the screen, without exchange of the card (refer to FIG. 10). One card exchange decides the outcome of a game. If a hand containing two pairs of the poker or a stronger hand is completed within the five cards 110, a player wins and the number of medals corresponding to the hand is given as a dividend. Otherwise, a player loses and the character. "GAME OVER" is displayed on the card display area 101 (FIG. 11). If the probability fluctuating hand is completed, the game is hereinafter performed in the probability fluctuation mode until a predetermined condition is satisfied.

As illustrated in FIG. 7, three lines of gauges 121*a* to 121*c* and counters 122*a* to 122*c* corresponding to the respective gauges 121*a* to 121*c* are provided in the bonus information display area 104. The progressive game system including the game machine 1 controls the payout of the above-mentioned progressive bonus into three stages depending on the winning probability. The gauge 121*a* and the counter 122*a* in the uppermost portion of the bonus information display window 120 correspond to the highest ranking hand with the lowest winning probability. The gauge 121*c* and the counter 122*c* in the lowest portion correspond to the lower ranking hand with the highest winning probability. The gauge 121*b* and the counter 122*b* in the middle portion correspond to the medium ranking hand with the medium winning probability. The amount of the progressive bonus (the number of the medals) in the case of the current highest ranking hand, medium ranking hand, lower ranking hand notified from the progressive unit is respectively displayed on the counters 122*a* to 122*c*. The respective gauges 121*a* to 121*c* are classified by color, for example, into red, yellow, and blue. Inside the gauges, characters 123*a* to 123*c* are displayed to show the remaining pieces to the finals. The initial position of the respective characters 123*a* to 123*c* is set at the left end portion of the respective gauges 121*a* to 121*c*. When the cards 110 are distributed to a player, if one of symbol marks respectively shown by the same color as each of the gauges 121*a* to 121*c* is distributed on some card, the character 123*a*, 123*b*, or 123*c* of the gauge 121*a*, 121*b*, or 121*c* corresponding to the above symbol mark is advanced to a right by one piece. If the character 123*a*, 123*b*, or 123*c* reaches the right end of the gauge 121*a*, 121*b*, or 121*c*, the progressive bonus as for the gauge 121*a*, 121*b*, or 121*c* is gained. Then, the number of the medals displayed on the counter 122*a*, 122*b*, or 122*c* is paid out as the progressive bonus. In this case, the number of the medals corresponding to the progressive bonus may be actually paid out, or the same number may be added to the credit number. Alternatively, a receipt describing the progressive bonus may be issued. When the progressive bonus is paid out, the winning character 123*a*, 123*b*, or 123*c* of the gauge 121*a*, 121*b*, or 121*c* is returned to the initial position.

This time, the processing of the CPU 10 for realizing the above-mentioned game will be described with reference to FIGS. 4 to 6.

When a predetermined game starting operation is performed on the game machine 1, the CPU 10 starts the game processing of FIG. 4. During the game processing, the CPU 10 adds one to the number of the credit (the number of the medals held by a player) stored in the RAM 16 every time the medal checking unit 19 supplies a signal indicating that the valid medal has been put in.

In the game processing of FIG. 4, predetermined initialization processing is at first performed (Step S1). The cards used for this game are set as a total of 53 cards including one joker and four suits; hearts, diamonds, clubs, and spades respectively consisting of 13 cards. The joker is treated as a wild card which can be used as any of the four suits.

Whether or not a player performs a predetermined bet operation (push operation of the one bet button 6*c* or the max bet button 6*b*) in the input unit 6 is discriminated (Step S2). When there is the bet operation, whether it is already in a state of the max bet or not is discriminated with reference to the number of the bets recorded in the RAM 16 (Step S3). When it is not in the state of the max bet, whether the number of the medals in accordance with the number of the bets has been credited or not is discriminated with reference to the credit number recorded in the RAM 16 (Step S4). When the credit number is satisfied, the probability fluctuating hand is added depending on the number of the added bets, and simultaneously, the credit number is decreased correspondingly to the number of the added bets (Step S5). The display about the credit number and the probability fluctuating hand on the poker game screen 100 is updated to the latest information recorded in the RAM 16 (Step S6).

Whether or not a player has performed an operation for distributing the cards (push operation of the button 6*a*) in the input unit 6 is discriminated (Step S7). When it proves that there is no such operation, this step will be returned to Step S2. When it is judged to be in the max bet state in Step S3, or when it is judged that the credit number is short in Step S4, Step S5 is omitted and the processing is advanced to Step S6.

When it is judged that the card distribution has been requested in Step S7, the CPU 10 decides a total of ten cards including the five cards 110 to be displayed at first and the next five cards to be exchanged with them and displayed (Step S8). At this time, ten cards are selected from the above-mentioned 53 cards if it is not in the probability fluctuation mode. On the other hand, in the probability fluctuation mode, the number of the jokers is changed to five and from a total of 57 cards, ten cards are selected. In any case, the random number is used for selection of a card. A probability of selecting each card is evenly set in the four suits. When the cards are decided in Step S8, whether or not a symbol mark associated with the progressive bonus is attached on the cards 110 is also decided. Alternatively, in Step S8, only the five cards to be displayed at first are decided, and thereafter, when exchange is requested, the next cards may be decided by the CPU 10.

Figure 10:
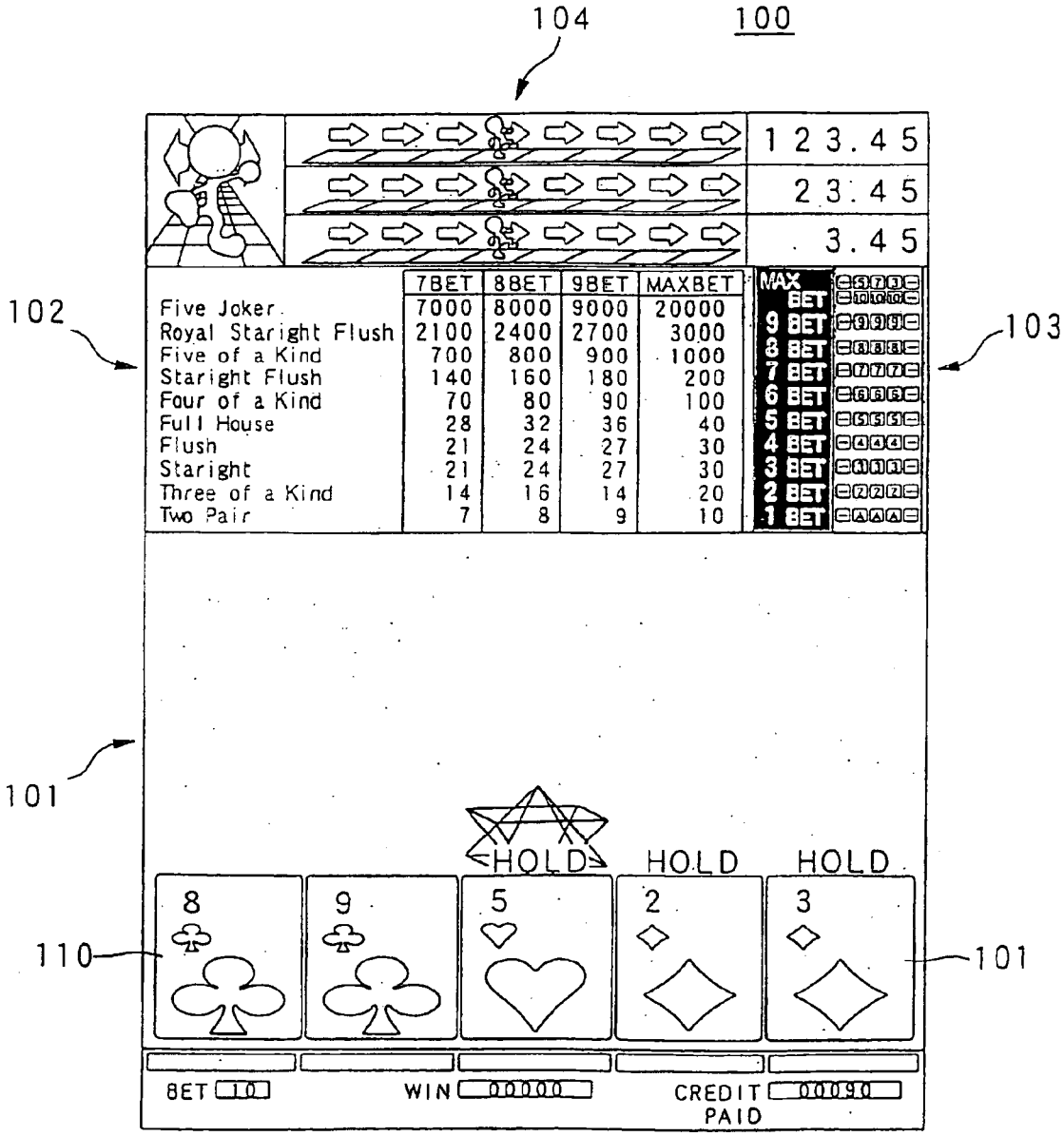
FIG. 10 is a view showing a screen in the state of defining a hold in one part of the cards of FIG. 9.
Figure 11:
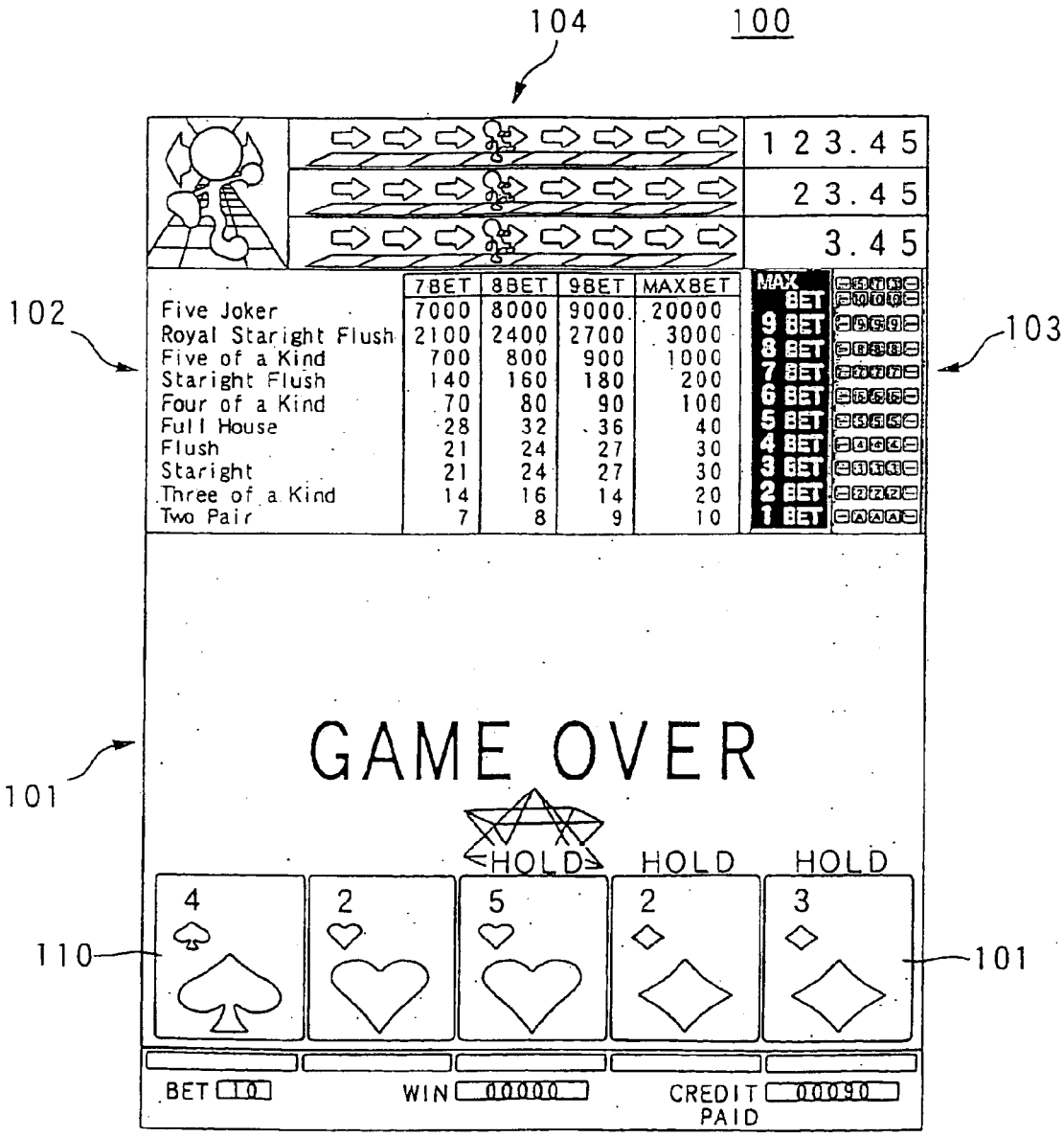
FIG. 11 is a view showing a screen when a player loses a poker game performed by the game machine of FIG. 1.
Figure 12:
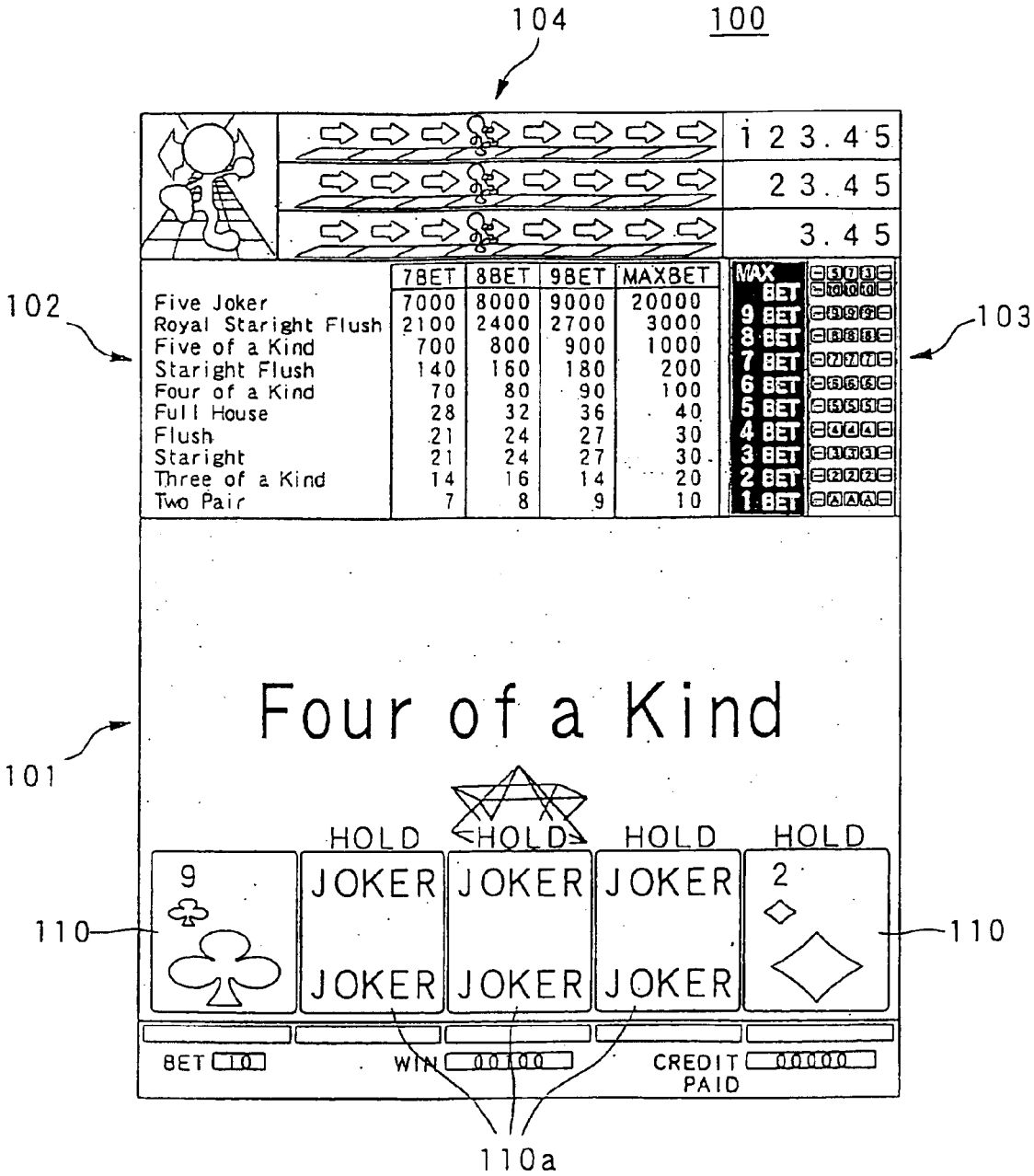
FIG. 12 is a view showing a screen in the state of completing a lucky hand in the probability fluctuation mode.

After the cards are decided, the same cards are displayed in the card display area 101 on the game screen 100 (Step S9, refer to FIG. 10). Based on the result decided in Step S8, the processing about the payout of a progressive bonus is performed (Step S10). The content of the processing is as mentioned above.

When the processing about the progressive bonus is completed, the processing is advanced to Step S11 of FIG. 5. In Step S11, whether a player pushes the hold button 6*f* or not is discriminated. When there is the push operation, the card 110 corresponding to the button 6*f* is set as a hold and the character "HOLD" is displayed on the screen 100 (Step S12, refer to FIG. 10).

When a hold is set or when it is judged that there is no hold operation in Step S11, whether or not a player requests distribution of the cards is discriminated (Step S13). This judgement is performed in the same way as in Step S7. When the distribution of the cards is not requested, the processing is returned to Step S11. When the distribution of the cards is requested, the cards other than the cards set as a hold are exchanged with the next cards and displayed (Step S14). Continuously, the processing about a progressive bonus is performed in the same way as in Step S10 (Step S15). Thereafter, the outcome of the game is determined (Step S16), and it is displayed (Step S17). Namely, whether or not a hand containing two pairs or more is completed in the five cards 110 being displayed at this point is discriminated. If it is completed, a screen showing the victory of a player is displayed, while if it is not completed, a screen showing the defeat of a player is displayed (refer to FIG. 11).

The processing is advanced to Step S18 in FIG. 6, where whether or not the probability fluctuating hand is completed is discriminated. If the probability fluctuating hand is completed, a total of 57 cards including five jokers and four suits; hearts, diamonds, clubs, and spades respectively consisting of 13 cards is set as the cards used for the game thereafter (Step S19), and three is added to the number of times of finishing the probability fluctuation mode recorded in the RAM 16 (Step S20). Thereafter, the processing is advanced to Step S21. When the probability fluctuating hand is not completed in Step S18, Step S19 and Step S20 are omitted.

In the following Step S21, whether or not a hand containing two pairs or more is completed is confirmed according to the discrimination result of Step S16. If the hand is completed, a dividend is given based on the hand and the number of the bets (Step S22). The dividend may be added to the number of the credit or the medals corresponding to the dividend may be paid out. After the reception of the dividend, one is subtracted from the number of times of finishing the probability fluctuation mode stored in the RAM 16 (Step S23), and thereafter, the processing is advanced to Step S24. Where, the minimum value of the number of finish times is zero, and when it is already zero, the subtraction is not performed. When the hand containing two pairs or more is not completed in Step S21, Steps S22 and S23 are omitted, and the processing is advanced to Step S24.

In Step S24, whether the number of finish times stored in the RAM 16 is zero or not is discriminated. When it is zero, a total of 53 cards including one joker and four suits; hears, diamonds, clubs, and spades respectively consisting of 13 cards is set as the cards used for the game thereafter (Step S25). Thereafter, the processing is returned to Step S2 of FIG. 4. When the number of the finish times is not zero in Step S24, Step S25 is omitted.

According to the above processing, if the probability fluctuating hand is completed, the number of the jokers thereafter is changed to five and the game is advanced in the above state until the hand containing two pairs or more is three times completed. Since a joker can be used for any of the four suits, even if a probability of selecting each card remains to be evenly set in the calculation at deciding a player's hand, a probability of completing a lucky hand is increased as the result. For example, a hand containing four cards (Four of a Kind) using three jokers 110*a*. . . 110*a* is completed on the screen of FIG. 12. Since the calculation expression is not operated, a player doesn't feel unnaturalness caused by the operation of the probability.

The present invention is not restricted to the above-mentioned embodiment, but various modifications can be made. A card game is not restricted to the poker, but various kinds of games may be performed. A card is not restricted to the trump card, but Japanese typical playing card, karuta, and the like can be used only if it can form a hand in combination of several cards. The present invention can be adopted not only to a card game, but also to a slot game and a bingo game. The present invention is not restricted to an arcade game machine, but also it may be formed as a game system using a domestic video game machine and a network. It is also possible to provide with a mode of intentionally decreasing the probability of completing a lucky hand by decreasing the number of jokers when a predetermined combination is formed in the poker game.

In the above embodiment, although the CPU as a game controller is worked as selecting device, dividend controlling device, probability controlling device, and condition controlling device, by combining the CPU with specified software, one part or all of these device may be replaced with a logic circuit combined with IC and LSI.

As set forth hereinabove, according to the present invention, a probability of completing a combination as a predetermined lucky hand can be varied by adding or removing the common symbol which can be used as a plurality of symbols, or by changing the content of the selection candidate group. Therefore, the present invention can provide a game system with the probability fluctuation mode without any intentional operation for increasing or decreasing the probability of selecting each symbol from the candidate group, thereby decreasing a player's unnatural feeling for the game content and enhancing a player's fun to the game.

What is claimed is:

1. A game system having a display unit capable of displaying a game screen, an input unit for supplying a signal corresponding to a player's operation, and a game controller for executing a predetermined game on the screen of the display unit with reference to an output signal from the input unit, in which the game controller comprises:

a selecting device which selects a predetermined number of symbols to be displayed on the game screen from a predetermined selection candidate group;

a dividend controlling device which controls a dividend for a player based on a combination of the selected symbols; and a probability controlling device which controls a probability of the dividend by adding or removing at least one common symbols, which can be used as a plurality of symbols, to or from the selection candidate group before the selecting device selects the predetermined number of symbols, according to an outcome of the game.

2. The game system according to claim 1, in which the probability controlling device adds the common symbol to the selection candidate group when the outcome of the game satisfies a predetermined start condition.

3. The game system according to claim 2, in which the probability controlling device judges that the start condition is satisfied when the combination of the selected symbols forms a predetermined probability fluctuating hand and adds the common symbol.

4. The game system according to claim 3, comprising a condition controlling device which increases the number of the probability fluctuating hands according as the value of a play that a player sets is greater.

5. The game system according to claim 2, in which the probability controlling device removes at least one common symbol from the selection candidate group when the outcome of the game satisfies a predetermined finish condition after the common symbol is added to the selection candidate group.

6. The game system according to claim 5, in which the probability controlling device judges that the finish condition is satisfied when the dividend controlling device produces a predetermined dividend and removes the common symbol.

7. The game system according to claim 5, in which the selecting device changes at least one part of the already selected symbols to another symbol selected from the selection candidate group, according to an instruction given from a player through the input unit, and the probability controlling device judges that the finish condition has been satisfied when the accumulated times the selected symbol forms a predetermined combination reaches a predetermined constant and removes the common symbol.

8. The game system according to one of claims 1 to 7, in which a probability of the selecting device selecting the respective symbols from the selection candidate group is evenly set in the respective symbols.

9. The game system according to one of claims 1 to 7, in which trump cards are used as the symbol, and the dividend controlling device produces a dividend when a predetermined lucky hand is formed by a combination of the selected symbols on a card game using the trump cards.

10. The game system according to claim 9, in which the probability controlling device adds a joker as the common symbol to the selection candidate or removes the joker from the selection candidate.

11. A game controlling method for executing a predetermined game on a screen of a predetermined display unit by using a computer installed in a game system, in which the computer executes the following processes of:

selecting a predetermined number of symbols to be displayed on the game screen from a predetermined selection candidate group;

controlling a dividend for a player based on a combination of the selected symbols; and controlling a probability of the dividend by adding or removing at least one common symbol, which can be used as a plurality of symbols, to or from the selection candidate group before the selecting device selects the predetermined number of symbols, according to the outcome of the game.

12. A computer readable storing medium which stores a program for executing a predetermined game on a screen of a predetermined display unit by using a computer installed in a game system, in which the program works the computer as a selecting device which selects a predetermined number of symbols to be displayed on the game screen from a predetermined selection candidate group;

a dividend controlling device which controls a dividend for a player based on a combination of the selected symbols; and a probability controlling device which controls a probability of the dividend by adding or removing at least one common symbol, which can be used as a plurality of symbols, to or from the selection candidate group before the selecting device selects the predetermined number of symbols, according to the outcome of the game.

* * * * *